United States Patent [19]

Horvath

[11] 4,057,176

[45] Nov. 8, 1977

[54] MANUALLY OPERATED SPRAY PUMP

[75] Inventor: William Horvath, Watchung, N.J.

[73] Assignee: Plastic Research Products, Inc., Warren, N.J.

[21] Appl. No.: 683,338

[22] Filed: May 5, 1976

Related U.S. Application Data

[63] Continuation-in-part of Ser. No. 597,293, July 18, 1975, abandoned.

[51] Int. Cl.[2] ..... B05B 7/32

[52] U.S. Cl. ..... 222/193; 222/321; 222/383; 222/384; 239/333

[58] Field of Search ..... 239/357, 355, 333, 331, 239/124; 222/193, 321, 384, 402.11, 380, 494

[56] References Cited

U.S. PATENT DOCUMENTS

| | | | |
|---|---|---|---|
| 1,930,872 | 10/1933 | Blackmun | 239/357 X |
| 3,053,459 | 9/1962 | Corsette | 239/337 |
| 3,064,865 | 11/1962 | Scoggin et al. | 222/380 X |
| 3,128,018 | 4/1964 | Corsette et al. | 222/321 |
| 3,226,035 | 12/1965 | Boris | 239/361 |
| 3,237,571 | 3/1966 | Corsette | 417/513 |
| 3,239,151 | 3/1966 | Boris | 239/333 |
| 3,248,021 | 4/1966 | Corsette et al. | 222/321 |
| 3,249,259 | 5/1966 | Corsette | 222/182 |
| 3,422,996 | 1/1969 | Lipman | 222/402.11 |
| 3,469,744 | 9/1969 | Corsette | 222/321 |
| 3,471,065 | 10/1969 | Malone | 222/321 |
| 3,489,322 | 1/1970 | Ayres | 222/384 X |
| 3,527,551 | 9/1970 | Kutik et al. | 222/380 X |
| 3,596,808 | 8/1971 | Corsette | 222/321 |
| 3,685,739 | 8/1972 | Vanier | 239/333 |
| 3,790,034 | 2/1974 | Horvath | 222/153 |
| 3,792,800 | 2/1974 | Capra et al. | 222/340 X |
| 3,940,029 | 2/1976 | Horvath | 222/340 |

FOREIGN PATENT DOCUMENTS

| | | | |
|---|---|---|---|
| 651,504 | 10/1928 | France | 239/357 |
| 848,688 | 9/1952 | Germany | 239/357 |

*Primary Examiner*—Robert B. Reeves
*Assistant Examiner*—Frederick R. Handren
*Attorney, Agent, or Firm*—Martha G. Pugh

[57] ABSTRACT

A reciprocating type of finger pump for use on top of a product container. This combines a tubular housing, including a laterally directed spray nozzle, mounted coaxially in the sleeve of an accumulator cap including a central valve. The valve opening leads to a dip tube which passes into a liquid reservoir in the container. The tubular housing, including the spray nozzle, is depressed manually so that it moves telescopically in the accumulator sleeve, driving a hollow piston against the tension of a spring. The first compression stroke serves to prime the pump, forcing a piston to close the valve to the dip tube. Simultaneously, air in an annular chamber of the housing surrounding the hollow piston is compressed. On the reverse or suction stroke, the valve to the dip tube is opened, creating a vacuum which causes the liquid to be sucked up from the reservoir and into the hollow piston. On the second or subsequent compression strokes, the compressed air and liquid are forced through normally closed pressure responsive seals into the inner mixing chamber, where the compressed air breaks up and atomizes the liquid, causing the atomized spray to move at high pressure through the spray nozzle. Simultaneously, the valve to the dip tube closes, air is drawn into and compressed in the outer annular chamber, and the cycle is ready to be repeated in response to the successive release and reapplication of pressure on the tubular housing. Means is provided in response to rotation of the cylindrical housing relative to the accumulator sleeve for locking the pump against compression for shipping or safety purposes.

28 Claims, 24 Drawing Figures

MANUALLY OPERATED SPRAY PUMP

BACKGROUND OF THE INVENTION

This application is a continuation-in-part of my application Ser. No. 597,293 filed July 18, 1975, now abandoned.

This relates in general to dispenser pumps, particularly to a type which is manually actuated to generate an atomized spray of a fluid product.

Many liquid spray dispensers of the types presently on the market use an aerosol cartridge to provide compressed gas for atomizing the liquid product and driving it out through the nozzle.

It has recently been found that certain of the gases most often used in spray cartridges, such as fluorocarbons, are highly toxic when inhaled by human beings. A fear among scientists is that the substantial volume of these gases being used all over the world may neutralize the ozone layer surrounding the earth, thereby admitting potentially cancer causing radiation from the sun. Another problem arising in prior art dispensers which employ cartridge carriers of the aerosol type is that the product is diluted by the carrier. Other problems inherent in usual types of prior art dispensers are that, in general, for mechanical dispersion of the liquid product, they require many intricate parts which are expensive to manufacture and easily get out of order. Some prior art dispensers include metal parts or springs which are actually in contact with the liquid product, and may thereby react, causing deterioration of the mechanism and toxic by-products. In other types of prior art dispensers, the product is prematurely exposed to the atmosphere, becoming cyrstallized or hardened in and around the spray orifice, causing clogging.

Summary of the Invention

Accordingly, it is a principal object of the present invention to provide an improved type of liquid dispensing device.

A more particular object of the invention is to provide a liquid dispensing device which generates a high-powered spray without the use of pressurized gases which may have harmful or toxic effects.

Another object of the invention is to provide a spray dispensing device in which the product is protected from atmospheric contamination, and which can be readily manipulated to produce a constant pressure, relatively dry spray which does not clog the orifice of the spray nozzle. Another object is to substantially eliminate "throttling" or dripping from the spray nozzle.

Another object is to provide a dispensing device with a minimum number of parts in order to provide fewer mechanical problems and to minimize manufacturing and assembly costs.

A further object of the invention is to provide a dispenser with no metal parts exposed to the product, permitting the dispenser to be used with a greater number of liquid products.

These and other objects are attained in the dispensing device of the present invention which makes use of a composite finger pump including dual systems which operate simultaneously and in synchronism, one system constructed to pump the liquid product, while the other system provides compressed carrier gas, which in the preferred embodiment is compressed air which mixes with and atomizes the product into a finely divided dry spray. Although the principal embodiment will be described with reference to a liquid product, it will be understood that application to other types of products, such as gases or vapors, or particulate materials, such as powders, are within the contemplation of the invention.

In a specific embodiment, the liquid pumping system employs a hollow inner piston of the composite nozzle housing which is constructed to move against the compression of a coil spring in reciprocating relation to an axially disposed cylindrical accummulator sleeve, the lower end of which provides at its center a seal for a mechanical valve having a substantially elliptical valve head. The first stroke on which the spray nozzle is compressed functions to prime the pump, positively sealing closed the valve to the liquid reservoir. On the up or suction stroke, pressure on the coil spring is released permitting the hollow piston and spray nozzle housing to return to normal position, creating a partial vacuum in the discharge chambers surrounding the valve stem as the valve head is lifted off of its seat. The liquid product is lifted from its container through a dip tube extending down into the liquid reservoir, past the valve opening in the accumulator and into grooved discharge chambers surrounding the valve stem. An automatic vent simultaneously releases air into the container. On the next compression stroke, the piston again moves against the valve head, closing the valve and compressing and forcing the product liquid from the discharge chambers up through the product passage or duct along the axis of the hollow piston, where the increased pressure forces the product liquid to push up on a preloaded diaphragm dislodging a plug, causing the liquid to break up and to enter an annular air and product mixing chamber adjacent the spray nozzle.

The air pumping system operates simultaneously with the liquid pumping system, making use of the annular chamber formed product a pair of upwardly directed sleeve of the accumulator in which the outer wall of the tubular housing, which includes the spray nozzle, moves telescopically. The housing has an outwardly directed peripheral flange, having spaced slots which engage guide lugs directed inwardly from the outer accumulator sleeve. When the nozzle is pushed down, after a short movement the annular chamber in the tubular housing is sealed and permits the enclosed air to be compressed. This compressed air is forced past a normally closed flexible seal, through a passage into the air and product mixing chamber at the end of the hollow piston where the liquid product is broken up to form a dry spray which is forced out through the spray nozzle on the second and subsequent compression strokes.

A particular feature of the invention is a locking arrangement which can be used for shipping the unit and making it resistant to use by small children. This is achieved by a turn of the nozzle through a small angle in a counterclockwise direction, which disengages the lugs from the guide slots, preventing the nozzle housing from being depressed. An arrangement of dimples and matching bosses serves to secure the spray nozzle housing in firmly latched position for shipping and carrying.

Other features and advantages of the dispenser of the present invention are the following:

a. it does not require the use of carrier gas cartridges which disseminate harmful gases into the atmosphere;

b. the use of an air carrier, as opposed to the usual fluorocarbon carriers, provides a more concentrated, less contaminated product;

c. mixing of compressed air carrier with the product in the mixing chamber provides a constant pressure, dry spray for the user, and tends to eliminate clogging of the nozzle orifice;

d. clogging of the orifice and pump chambers is further prevented by means for retaining the stored product closed to exposure to the atmosphere when the pump is in neutral position so that the product is not left to crystallize or harden;

e. the pump combination of the present invention includes no metal parts exposed to the product;

f. because of (c), (d) and (e), the combination of the present invention can be used to dispense a large variety of products, such as salt solutions for deodorant purposes, which prior art dispensers have not been able to handle satisfactorily;

g. the pump mechanism is simple and economical to manufacture, assemble and maintain in view of the fact that it includes only seven working parts, as opposed to eleven or more in prior art dispensers;

h. the mechanical check valves are designed to provide positive opening and closing;

i. means for automatically venting the air prevents the container from collapsing, and enables the pump to function correctly, j. the need for mechanical means for breaking up the product is eliminated by forcing the product through a series of serrations or past the annular shoulder, surrounding a diaphragm-supported plug, and exposing the product in the mixing chamber to turbulence created by a high pressure stream of air; and k. the locking means actuated by a slight rotation of the spray nozzle housing eliminates the necessity for an enclosing cap.

BRIEF DESCRIPTION OF THE DRAWINGS

These and other objects, features and advantages will be better understood from a detailed study of the invention with reference to the attached drawings, wherein.

DETAILED DESCRIPTION

Figures 1, 2B, 6A, 6B, 6C:
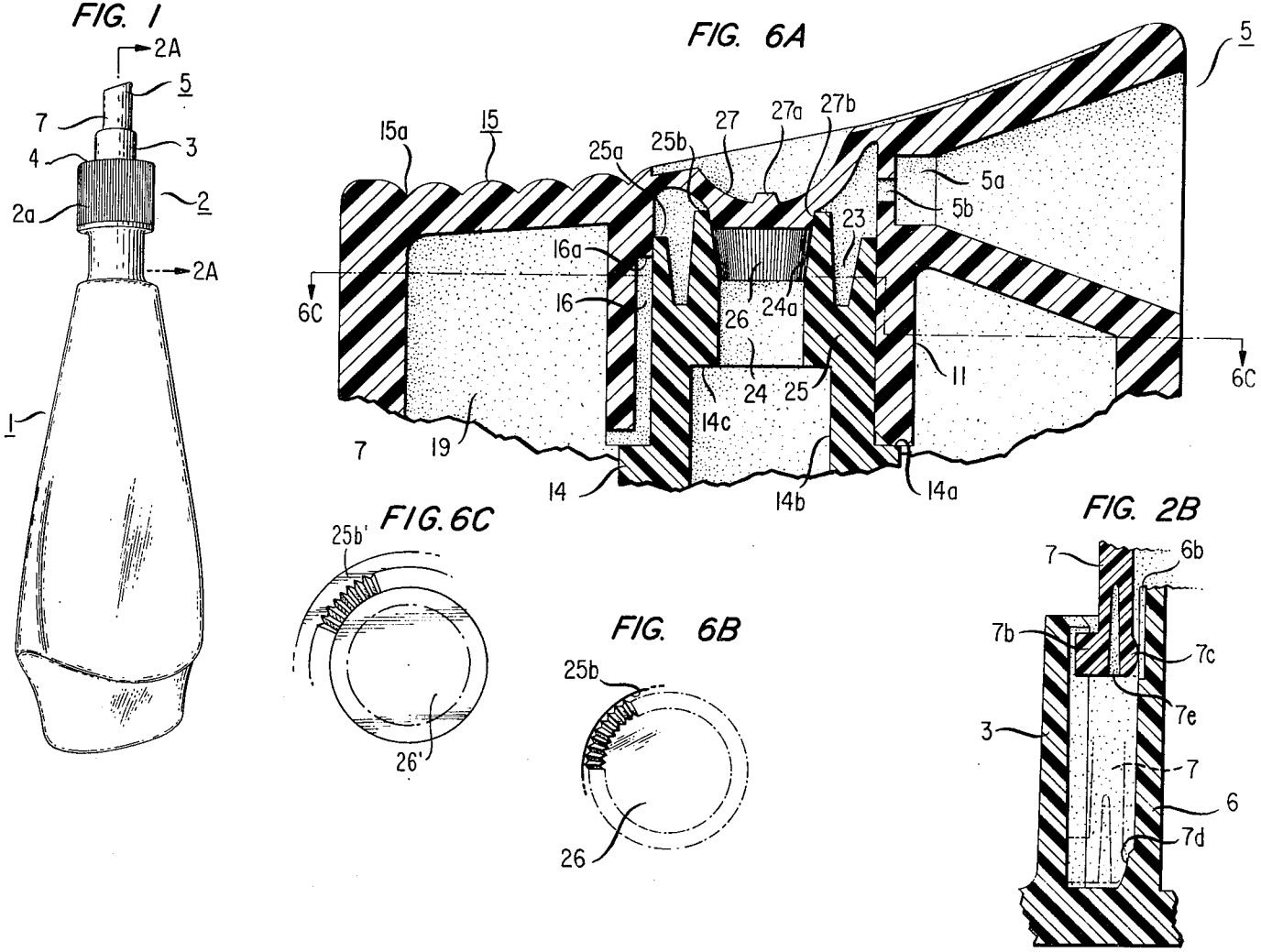
FIG. 1 shows in perspective a container in combination with a spray dispenser of the present invention.
FIG. 2B is an enlarged fragmentary showing of the lower end of housing 7 of FIG. 2A, in telescopic engagement with sleeve 3.
FIG. 6A is an enlarged vertical sectional showing of the upper end of the spray nozzle housing in neutral position, showing the grooved plug and channels leading from the interior of hollow piston 14 into the mixing chamber 23.
FIGS. 6B and 6C are views, looking up from the bottom, of two alternative forms of plug 26, of FIG. 6A disposed in the bore of ring 25b.

FIG. 1 of the drawings is a perspective showing of a conventional bottle or container for a liquid product on which is mounted a spray nozzle in accordance with the present invention. In the present example, a small plastic container 1 has a body portion which measures about 0.875 inch in maximum outer diameter and is 11 inches tall, terminating at its upper end in a conventional screwthreaded neck of reduced diameter, above which is an open mouth, the outer diameter of which measures 0.775 inch in the present embodiment. The bottle or container 1 may be formed of any type of rigid plastic, glass or other suitable material.

Figure 2A:
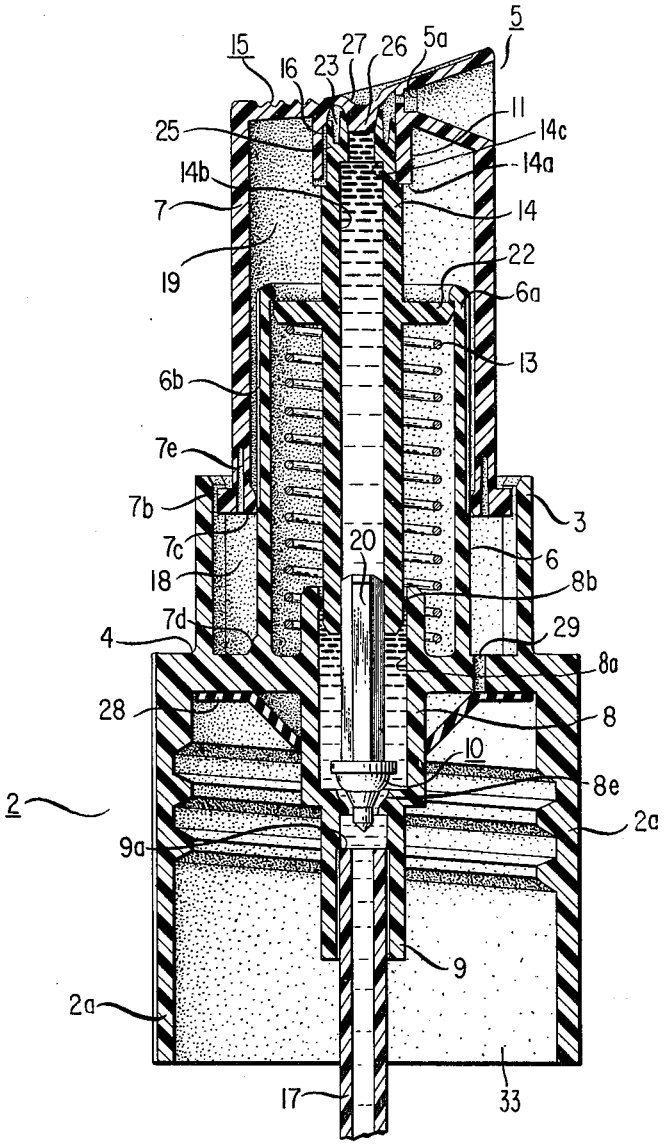
FIG. 2A is an enlarged vertical section taken through the plane 2A—2A of FIG. 1, showing the spray dispenser of the present invention in neutral or suction position.

The finger pump or dispenser of the present invention, in accordance with a first embodiment of FIG. 2A, under description, comprises seven principal parts, indicated by the following lettered paragraphs:

a. The screw cap accumulator 2 includes in integral relation a lower cylindrical skirt **2*a* and an annular closure 4 which fits onto the top of container 1 and is in coaxial relation with a central valve housing 8. The upwardly directed annular sleeve 3 coaxially surrounds spring housing 6, forming part of the air intake chamber 18 coaxial with the upper end 8a of valve housing 8 (see FIG. 2A**).

b. The spray nozzle housing 7, the lower end of which is accommodated telescopically in annular sleeve 3, is integrally formed to include the laterally directed spray nozzle 5 and an inwardly directed axially disposed spring plug 26, surrounded coaxially by a downwardly directed tubular receptacle 11. A slotted flange **7*b* on the lower periphery of housing 7 is constructed to engage lugs 3*a* on the inside of cylindrical sleeve 3 to maintain the housing and sleeve in the proper orientation. Each of lugs 3***a* has a slightly recessed portion 3*a* at one end to provide a locking mechanism when housing 7 is slightly rotated relative to sleeve 3. (See FIG. 3.)

c. Coil spring 13 is constructed to fit into spring housing 6.

d. Piston tube 14 is constructed so that its lower end fits inside of coil spring 13 and includes partway along its length an annular flange 22 which bears on and serves to compress coil spring 13. The fitting 25, which comprises a complex hollow molding at the top of piston tube 14, is constructed for fixed engagement with receptacle 11, surrounding spring plug 26.

e. Valve head 10, formed integrally with valve stem 20, which may be of cruciform section, is mounted longitudinally in the valve housing 8, so that valve head 10 is disposed to seat in the valve opening 8*e.* The upper end of valve stem 20 fits slidably into the bore 14*b* of tube 14, which in turn fits slidably into the upper chamber 8*a* of the valve housing 8, so that the lower end of tube 14 is constructed to move against and bear on valve head 10.

f. A diaphragm 28 is constructed to seal and unseal a small opening 29 in the annular closure 4 to maintain the reservoir in container 1 at atmospheric pressure.

g. Dip tube 17 is constructed to communicate between the lower end 9 of the valve housing 8 and the reservoir in container 1.

When the nozzle housing 7 is depressed, compressing tube 14 and flange 22 against the coil spring 13, the lower end of tube 14 is forced against the valve head 10, sealing the valve closed.

In the embodiment under description, screw cap accumulator 2 and all of its integrally molded parts may comprise any rigid or semirigid plastic material well-known in the art such as, for example, injection molded polypropylene. Skirt 2a of accumulator 2 is one inch in outer diameter, 0.875 inch in inner diameter and 0.850 inch in vertical extent, having inwardly directed screw-threaded grooves or, alternatively, metal crimping, formed to accommodate the screw threads on the container neck. Formed in integral coaxial relation with screw top accumulator 2 is a hollow cylindrical sleeve 3 of the same material, having an outer diameter of 0.775 inch and an inner diameter of 0.6875 inch and extending upward 0.4 inch above the closure 4 which forms an annular shoulder 0.1 inch wide. Protruding in a horizontal plane from the inner wall of sleeve 3 are a plurality of symmetrically spaced flanges 3*a,* each of which extends about 0.02 inch around the periphery and which are separated by intervening slots 3*b.* (see FIG. 3.) At the clockwise end of each of flanges 3*a* is a recessed area 3*c,* about 0.06 inch in a peripheral direction and 0.04 inch wide, which functions as part of the mechanism for locking the spray housing 7 against compression. This combination of elements 3*a,* 3*b* and 3*c* cooperates with matching lugs 7b on the interior of spray cylinder 7, as will be presently explained. The structure is indicated in detail in FIG. 2A, which shows a vertical section through the plane 2A—2A of FIG. 1, and in FIG. 3, which is a top view of FIG. 2A.

From FIG. 2A it is seen that the annular shoulder at the top of the cylindrical accumulator 2 is a continuation of a horizontal annular partition 0.08 inch thick, which extends from the outer wall of accumulator skirt 2*a* to the outer wall of coaxial valve housing 8, integrally supported at its center.

Located coaxially inside of the outer cylindrical sleeve 3 is the hollow inner sleeve 6, which is 0.5 inch in outer diameter and 0.42 inch in inner diameter, extending vertically upward 0.82 inch from the upper face of partition 4 and terminating in an inwardly directed, curved bead 6*a,* 0.03 inch from the top, which has a radius of 0.015 inch. Inner sleeve 6 houses the coil spring 13. In the embodiment described, this comprises, say 20 coils of galvanized music wire, would helically to an outer diameter of 0.36 inch. Spring 13 must be sufficiently resilient to return the nozzle 5 to its original position when compression is released.

The annular lateral flange 22, which is 0.06 inch thick and extends 0.1 inch out from the cylindrical surface of the 0.19 inch diameter piston tube 14, is located 0.69 inch above the lower end of the latter. When tube 14 is in place, flange 22 bears against the upper end of coil spring 13, which is disposed in the annular chamber between tube 6 and the outer wall of tube 14.

Piston tube 14, which may be formed, for example, of injection molded polyethylene, extends at a uniform diameter 0.26 inch vertically upward from the upper surface of flange 22 to an annular horizontal shoulder 14*a,* on which is mounted end fitting 25 of reduced diameter which will be described subsequently. The inner bore 14*b* of piston tube 14 extends vertically upward 1.06 inches, at a uniform diameter of 0.1 inch, from the lower end of piston tube 14 in contact with valve stem 20, forming at its upper end an internal annular shoulder 14*c,* 0.02 inch wide, terminating in a cylindrical chamber 24, to be described in detail later with reference to FIGS. 6A et seq.

Also, it will be seen from FIG. 2A that the upwardly directed outer sleeve 3 and coaxially disposed inner sleeve coil spring housing 6 form between them an annular air intake chamber 18, 0.09 inch wide in a radial direction and 0.4 inch deep, which cooperates with the cylindrical spray nozzle housing 7. At the lower end of spray nozzle housing 7 which, together with its parts, is of injection molded polypropylene, is one of four symmetrically spaced, outwardly directed peripheral annular lugs 7*b* of rectangular section, each of which protrudes 0.03 inch in a radial direction, extends about 0.025 inch around the periphery and is 0.06 inch deep. (See also FIG. 3.) These cooperate with flanges 3*a* and intervening slots 3*b,* as previously described, to guide the telescopic movement of cylinder 7 in sleeve 3, and with recessed areas 3*c* for locking against vertical motion, when cylinder 7 is turned a few degrees on its axis.

The lower end wall of spray nozzle housing 7 has a vertical split 7*e,* 0.125 inch long, which tapers in width from 0.02 inch at the lower open edge to 0.01 inch at the top. This provides flexibility to the wall. Near the peripheral edge of 7 is an inwardly directed annular bead 7*c* which is centered 0.05 inch above the lower edge and directed 0.01 inch inward. The lower edge of spray nozzle housing 7, including outer lugs 7*b* and inner bead 7*c,* is accommodated in the annular air intake chamber 18 between outer sleeve 3 and inner sleeve spring housing 6. Three symmetrically spaced vertical slots 6*b,* 0.05 inch deep and extending 0.4 inch down from the top edge of housing 6 accommodate the inner bead 7*c* for a vertical distance 0.1 inch below the upper end of chamber 18, serving as air intake valves into chamber 19. When housing 7 moves down, bead 7*c* seals against the wall of spring housing 6, closing the air intake slots into chamber 19.

It will be noted that at one place on the external circular junction between spring housing 6 and partition 4 is a kickout contact button *7d* which is shown in enlarged detail in FIG. 2B. The button *7d* is of substantially triangular cross-section, 0.03 inch high and about 0.03 inch around the base, having a curvilinear surface. This functions at the end of the down stroke of the hollow piston tube 14 to raise the lower end of spray nozzle housing 7 to provide clearance for air intake into chamber 19, and to facilitate the return of housing 7 to its initial position.

The downwardly projecting central portion of axially supported cylindrical valve housing 8 has an outer diameter of 0.27 inch and an inner diameter of 0.19 inch and extends 0.26 inch below the lower surface of partition 4. The lower end of valve housing 8 is partially closed by a partition *8e,* 0.04 inch thick, which projects inwardly to form an annular surface 0.035 inch wide on its upper face, operating as a circular valve seat. This provides an opening 0.12 inch in diameter at its upper end which narrows to a diameter of 0.06 inch at its lower end, the upper inner surface being slightly spheroid to accommodate the valve head, which will be described presently.

Integral with and extending coaxially downward 0.35 inch below the lower end of valve housing 8 is a tube 9 which is 0.19 inch in outer diameter and 0.125 inch in inner diameter at its lower end. This is constructed to accommodate dip tube 17 which may, for example, be of extruded polyethylene, which is slightly less than 0.125 inch in outer diameter and 0.060 inch in inner diameter and is constructed to extend down into the bottle or container 1. At a vertical distance 0.075 inch from the inner end of downwardly extending tube 9 is a slight shoulder *9a,* 0.01 inch wide, which holds the end of dip tube 17 in place. Above this shoulder is provided a small chamber 0.11 inch in diameter and 0.08 inch in vertical depth, functioning as a reservoir for operation of the valve head 10.

The spray nozzle housing 7, which includes at its upper end the laterally directed spray nozzle 5, is 0.61 inch in outer diameter, 0.52 inch in inner diameter and 1.05 inches in overall vertical extent. The wall of the housing diametrically opposite spray nozzle 5 is 0.92 high, and the wall height on the other side up to the lower end of the spray nozzle opening measures 0.83 inch.

The upper end of cylindrical spray nozzle housing 7 is closed except for spray nozzle 5, with a circular top 15 which is 0.04 inch in overall thickness, and substantially flat, except for a series of parallel serrations 15*a* which serve to provide a good grip for the user. (See FIG. 3.) At the center of the top 15 is a tiny spheroid depression 27, about 0.1 inch in diameter and 0.04 inch deep, which functions as a diaphragm, and has at its center a small raised contact point *27a.* Centered internally and formed integrally with diaphragm 27, which is 0.015 inch thick, is spring plug 26, as will be described. The details of these elements are more clearly shown in FIGS. 6A, 6B, 6C and 6D.

The spray nozzle 5, of injection molded polypropylene, is formed integrally at one side of top 15 and takes the form of a laterally directed frustrum of a hollow cone with walls 0.03 inch thick, having a lateral opening extending 0.25 inch in outer diameter. The opening is rounded off at the top and forms an upwardly directed angle of 30° with the horizontal plane of top 15. An arrow 30 is embossed on the top to indicate the spray direction. The maximum inner diameter at the outer end of spray nozzle 5 is 0.175 inch, decreasing conically to 0.05 inch in diameter at the inner end, forming a small cylindrical chamber 5*a* which is 0.03 inch deep, bounded at its inner end by a wall 0.015 inch thick. This has a central aperture 5*b* which is 0.015 inch in diameter.

Adjacent to and integral with the inner end of the spray nozzle 5, and projecting downwardly from the center of top 15, coaxial with internal plug 26, is a tubular receptacle 11 having an outer diameter of 0.22 inch and an inner diameter of 0.16 inch. This is coaxially surrounded by the outer wall of spray nozzle housing 7. On the side opposite spray nozzle 5, the external shell of receptacle 11 extends 0.15 inch from the lower face of the housing top 15. At a distance 0.02 inch below the top, at one place around its periphery, as shown in FIGS. 6A and 6D, receptacle 11 is slotted internally to form a channel 16 which is 0.01 inch square in section, and extends 0.13 inch vertically down, forming at its lower end a right angle bend providing an opening which continues for 0.02 inch to an outlet into annular variable volume air chamber 19. (See FIGs. 6A and 6D.) Chamber 19 is formed between the inner wall of spray nozzle housing 7 and the outer wall of piston tube 14. The upper end of slot 16 terminates in an inwardly directed shoulder 16*a* located 0.06 inch below top 15, and cut back about 0.01 relative to the contacting inner ring *25a,* which in neutral position bears against the interior wall of 11 about 0.01 inch above shoulder 16*a.* As shown in the second position of FIG. 6D, the presence of compressed air in channel 16 deflects ring *25a,* letting air into mixing chamber 23.

On the side adjacent the spray nozzzle 5, receptacle 11 extends 0.16 inch below the floor of nozzle chamber *5a,* having a uniform wall thickness of 0.03 inch. Receptacle 11 is adapted to accommodate in fixed relation the upper end fitting 25 of the tubular piston 14. The latter projects above shoulder 14*a* and, the manner in which it is fitted into the receptacle 11 is shown in enlarged longitudinal sectional detail in FIG. 6A. End fitting 25 comprises a pair of concentric annular rings 25*a* and *25b,* separated by an annular groove 23. The outer peripheral edge of end fitting 25 is 0.016 inch in outer diameter and projects 0.15 inch vertically above shoulder 14*a,* terminating in external outer annular ring 25*a* which is 0.01 inch wide. On the inner periphery, annular inner ring 25b, also 0.01 inch wide, has an outer diameter of 0.01 inch at its top edge and extends 0.02 inch above *25a.* Annular groove 23, between projecting rings 25*a* and *25b,* is 0.06 inch deep, measured from the top of *25b,* and 0.01 inch across the bottom.

The internal bore 14*b* of piston tube 14 is 0.1 inch in diameter and extends at uniform width 0.05 inch above the shoulder 14*c,* at which plane it is narrowed to coaxial chamber 24 which is 0.06 inch in diameter and extends 0.06 inch along the axis. At the upper end of end fitting 25, above cylindrical chamber 24, is another chamber 24*a* of inverted conical shape, which extends 0.05 inch vertically, and is concentric with the rings 25*a* and *25b,* widening out into a receptacle of slightly enlarged diameter, 0.07 inch at its upper end. This accommodates the frustroconical spring plug 26, which is, as previously stated, protrudes downward from the semispherical diaphragm 27, preloaded at, say, 30 pounds. The plug 26 is 0.06 inch across its upper end and extends vertically down 0.04 inch, having a slightly smaller diameter of 0.05 inch at its lower end.

As shown in FIG. 6B, which is a view looking up from the bottom, the plug 26 is fluted in a substantially vertical direction around its periphery to provide small channels for the escape of liquid from the tube 14 into the chamber formed by groove 23. Alternatively, as shown in FIG. 6C, the inside wall 25*b*′ can also be fluted in a substantially vertical direction instead of fluting the cylindrical wall of plug 26′. It will be seen that concentric with plug 26 on the inner surface is an annular internal shoulder 27*b* which is 0.07 inch in outer diameter and 0.001 inch wide, and which fits snugly against the upper internal side walls of ring 25*b*. Shoulder 27*b* is held in position against the annular ring 25*b* until the internal pressure of liquid passing up through the bore 14*b* and accumulating in chamber 24 exceeds a given amount, causing plug 26 to move upward, disengaging shoulder 27*b* and thereby providing an opening to the chamber provided by groove 23.

Figure 6E:
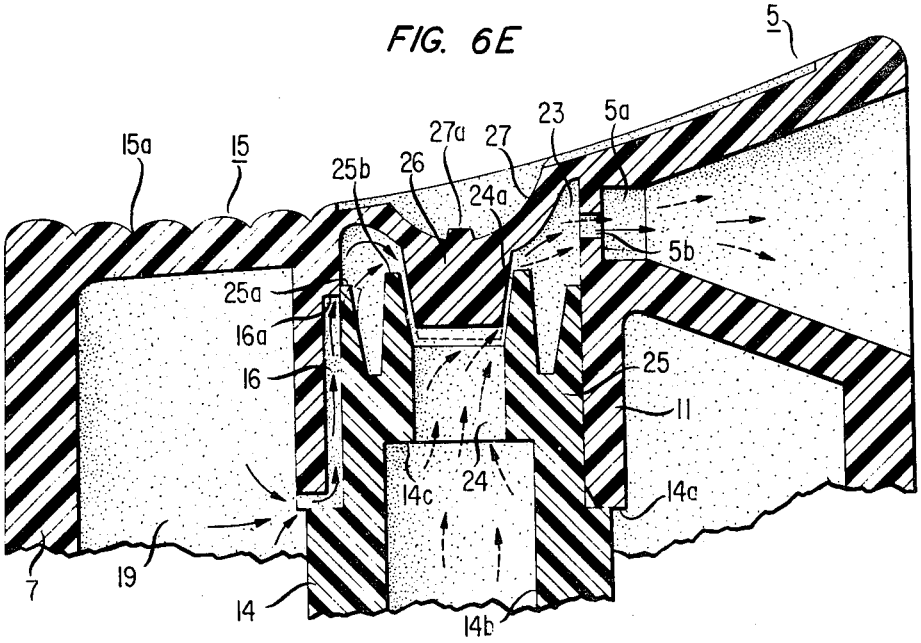
FIG. 6E is an enlarged sectional showing similar to FIG. 6A in which the plug 26 is raised to admit liquid product to the mixing chamber; and the compressed air intake is alternatively in closed and open positions.
Figure 6D:
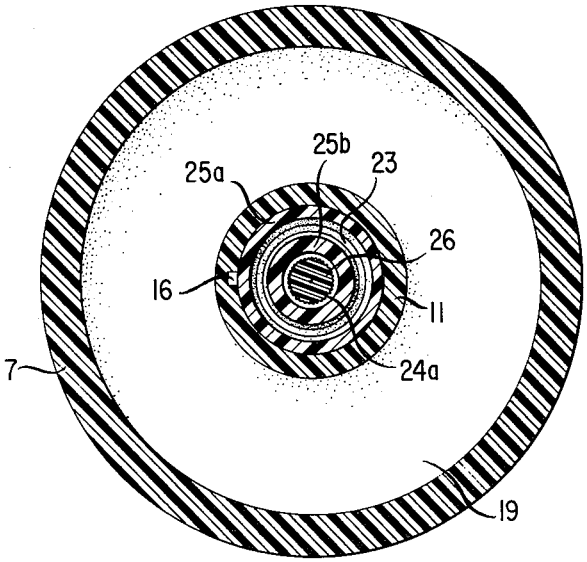
FIG. 6D is a cross-section through the plane 6C—6C of FIG. 6A.

As previously indicated, FIG. 6A shows this internal structure in detail when the pump is in neutral position; whereas, FIG. 6E shows to change in the position of the elements during the second or subsequent pressure strokes, following the suction part of the pump cycle, when the internal pressure of the rising liquid lifts the shoulder 27*b* off of the ring 25*b*. FIG. 6E also shows shoulder 16*a* in both closed and open positions for the flow of compressed air from channel 16 to mixing chamber 23.

The body portion of inner piston tube 14 has an outer diameter of 0.19 inch and an inner bore diameter of 0.1 inch, and is disposed axially within the spray nozzle housing 7, extending vertically down one inch below shoulder 14*a*. Returning to FIG. 2A, when the outer wall of 7 is accommodated in air chamber 18, between the outer cylindrical sleeve 3 and the inner sleeve comprising spring housing 6, the lower open end of piston tube 14 is slidably accommodated in the upper open end 8*a* of valve housing 8. In neutral or extended position of the pump, the external surface of 14 extends down into 8 about 0.1 inch and is in contact with the bead 8*b* which protrudes inwardly about 0.01 inch and is centered 0.04 inch from the upper end of the inner surface of 8*a*. Simultaneously, 0.1 inch of the lower end of the internal bore 14*b* of piston tube 14 is in contact with the peripheral edges of crucifform valve stem 20.

Figure 5B:
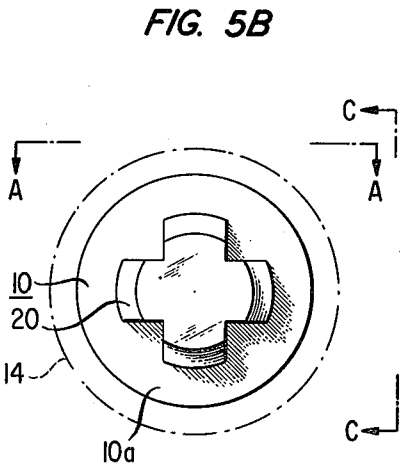
FIG. 5B is a plan view of the valve stem through the section 5B—5B of FIG. 5A.
Figure 5C:
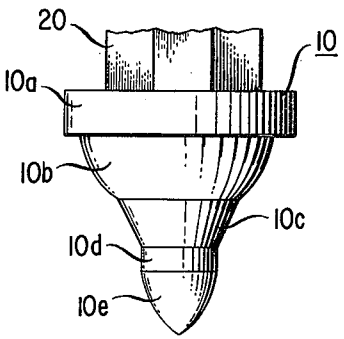
FIG. 5C is a showing of the valve head of FIG. 5A turned through an angle of 90 degrees.
Figure 5A:
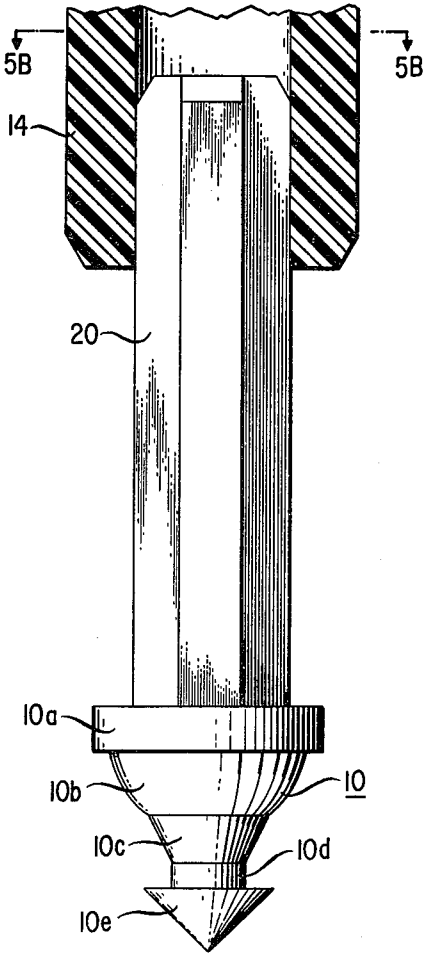
FIG. 5A is an enlarged perspective showing of the valve head of FIGS. 2A and 4, including the stem.

The valve head 10 and cruciform valve stem 20, preferably of low density polyethylene, are shown more clearly in FIGS. 5A, 5B and 5C, the latter figure showing the combination turned through 90° in a horizontal plane. The upper end of valve head 10 comprises a cylindrical wafer 10*a*, 0.15 inch in diameter and 0.03 inch thick. Formed coaxially with the lower surface of cylindrical wafer 10*a* is a truncated spheroid 10*b*, 0.125 inch in diameter which extends 0.04 inch along the axis, and appended in coaxial relation to which is a frustrum of a cone 10*c* extending 0.03 inch along the axis and decreasing from a diameter of 0.075 inch at its upper end to 0.05 inch at the lower end. This terminates in a cylinder 10*d*, 0.05 inch in diameter and 0.015 inch thick in a vertical direction. On the lower end of the latter is mounted a cone 10*e* of elliptical cross-section, extending 0.04 inch downward to an apex, having at its upper end a maximum diameter of 0.08 inch and a minimum diameter of 0.05 inch.

The valve stem 20, which is 0.415 inch in maximum vertical length, extends up vertically in coaxial relation to the center of cylindrical wafer 10*a* of valve head 10. As clearly shown in FIG. 5B, the cross-section is cruciform, 0.10 inch in maximum width, the legs of the cross being 0.04 inch wide and projecting out 0.04 inch. At the top of the stem, one pair of legs is recessed 0.015 inch relative to the other, to aid in initially orienting the valve head 10 in the valve seat 8*e*.

Figure 5D:
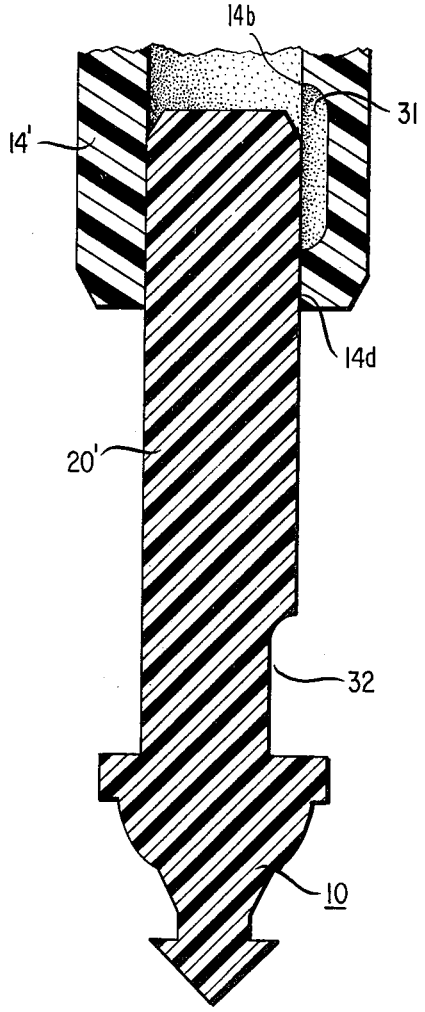
FIGS. 5D and 5E disclose a variation of the valve stem shown in FIG. 5A, in extended and retracted position.
Figure 5E:
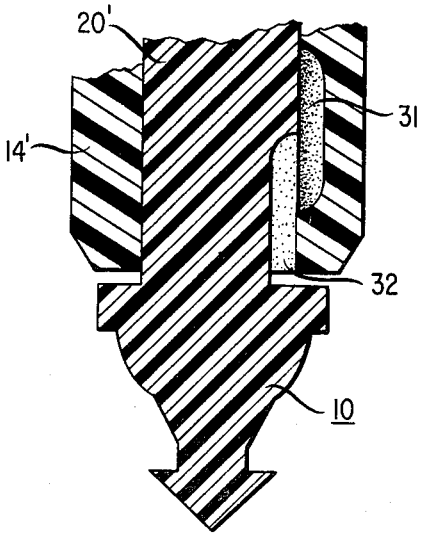

It will be understood that instead of being cruciform in cross-sectional shape, as shown in FIGS. 5A, 5B and 5C, the valve stem 20 can assure other forms. For example, as shown in FIGS. 5D and 5B, the valve stem 20′ is substantially round in cross-section, except for an indentation 32 which extends several mils in a vertical direction and is recessed about one mil into the lateral wall of 20′, and extends down to the upper face 10*a* of valve head 10. Correlative to the indentation 32 is an indentation 31 in the inner bore 14*b* at the lower end of the piston 14. The indentation 31 is similar in vertical extent and depth to indentation 32 and is about one mil up from the bottom end of piston 14. It will be apparent that when the piston 14 is in raised or neutral position, the lower end 14*d* of the bore 14*d* is sealed against the cylindrical periphery of the valve stem 20′. When the piston is lowered, during the compression strokes, the indentations 31 and 32 are adjacent, as shown in FIG. 5B, permitting liquid to pass around the valve head 10 and into the piston bore 14*b*.

Drilled in the top 4 of screw cap accumulator 2 (see FIGS. 2A and 4) is an opening 29 which is 0.02 inch in diameter, leading down into the liquid reservoir in the container 1, from the air intake chamber 18. The annular diaphragm 28, which is formed of a sheet elastomer such as, for example, neoprene, is 0.02 inch thick. It adheres frictionally to the outer wall of the valve housing 8, with its lower end 0.15 inch below the inner surface of 4, forming an angle of substantially 45° with the side wall. The flat annular upper surface of diaphragm 28 is 0.13 inch in radial width, its inner edge 0.12 inch from the wall of the housing 8. Diaphragm 28 is held in place at its outer end by the top of the container on which the accumulator cap is screwed, so that it just covers the opening 29, which is sealed closed when the pressure in chamber 33 is greater than the pressure in air intake chamber 18 and which opens to admit air when there is a pressure differential.

Operation of Embodiment of FIGS. 2A et seq.

Figure 4:
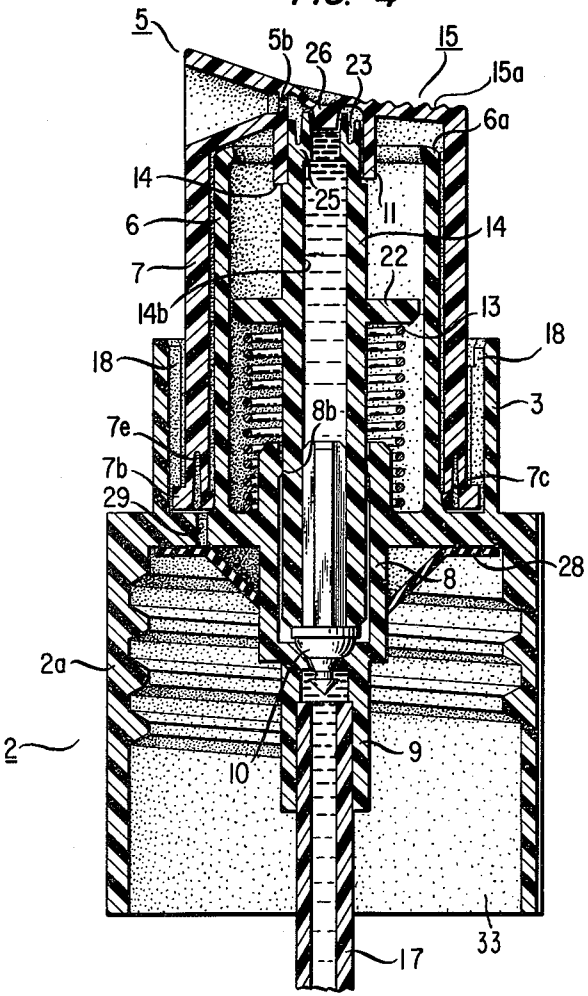
FIG. 4 is an enlarged vertical section similar to FIG. 2A, except that the pump is in compressed position.

FIG. 2A shows the pump in neutral position; whereas, FIG. 4 shows the pump in completely compressed position.

On the first down stroke the spray mozzle housing 7 is pressed down, forcing piston tube 14 by means of its flange 22, to compress spring 13. The lower end of piston tube 14 moves against the annular flange 10*a* of valve head 10, forcing the latter into a positive seal with valve seat 8*e*. This closes the valve and forces any liquid in the valve housing 8 into the grooves of cruciform valve stem 20, or the recesses 31, 32, if a round valve stem is used. Simultaneously, air is compressed in variable volume air chamber 19 and forced through slot 16, forcing ring 25*a* to deflect off of shoulder 16*a*, admitting air into the mixing chamber 23.

On the up stroke the spring 13 returns from its compressed position, shown in FIG. 4, simultaneously causing the piston tube 14 and the nozzle housing 7 to move back to neutral position, as shown in FIG. 2A. During this stroke, the valve head 10 is released from valve seat 8*e*, and the product liquid is pumped up into the upper section 8*a* from the container reservoir through the dip tube 17, through the grooves of the cruciform valve stem 20 and the bore 14*b* of piston tube 14. The diaphragm 28 if flexed, automatically admits air into the container through opening 29.

On the second down stroke, when spray nozzle housing 7 is pushed down, the outwardly directed lugs 7*b* act as guides, riding in slots 3*b* to prevent lateral motion. At the top of the stroke, through a vertical excursion 0.1 inch down into chamber 18, the air intake slots 6*b* are open to admit air to chamber 19. When the inwardly directed bead 7*c* moves below the bottom of slots 6*b,* the variable volume air chamber 19 is sealed and the air in it is compressed. The increased pressure forces air up through the slot 16, deflects the ring 25*a* from shoulder 16*a,* and causes air to be admitted to mixing chamber 23. At the end of the downstroke, button 7*d* is contacted, raising the lower end of spray nozzle housing 7, causing air to again be admitted into air chamber 19.

Simultaneously with the downward motion of spray nozzle housing 7, the tubular piston 14 compresses the product in the grooves of cruciform valve stem 20 and the pressure automatically seals valve head 10 into valve seat 8*e.* The increased product pressure forces product from chamber 24 up through slots 24*a,* forcing the shoulder 27*b* to be raised off of ring 25*b.* (See FIG. 6D.). Thus, product liquid is forced into the mixing chamber 23, breaking up in the process and mixing with the compressed air which is admitted from the opposite side of the chamber, creating a swirling motion and substantial turbulence which serve to further break up and atomize the product mixture, whih is then dispensed as a dry mist through the orifice 5*b* of spray nozzle 5.

Figure 3:
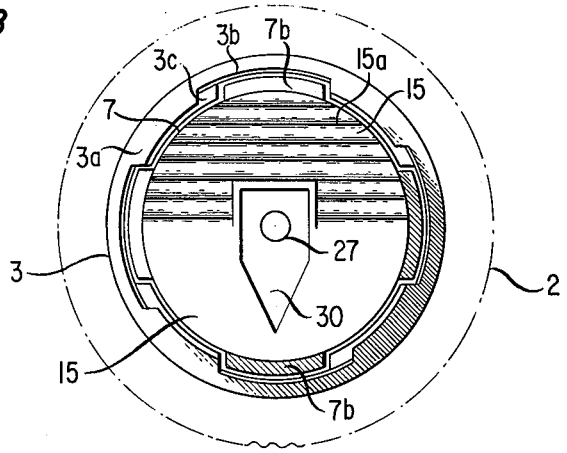
FIG. 3 is an enlarged top view of the spray dispenser shown in FIG. 2A of the drawings.

For locking purposes of the embodiment of FIGS. 2A et seq., the spray nozzle housing 7 is lifted slightly and turned clockwise 0.05 inch to provide a secure locking position, causing lugs 7*b* to engage the recesses 3*c* (See FIG. 3). This serves to secure the pump against compression for shipping purposes and to render it resistant to operation by small children.

Modified Embodiment

Figure 7A:
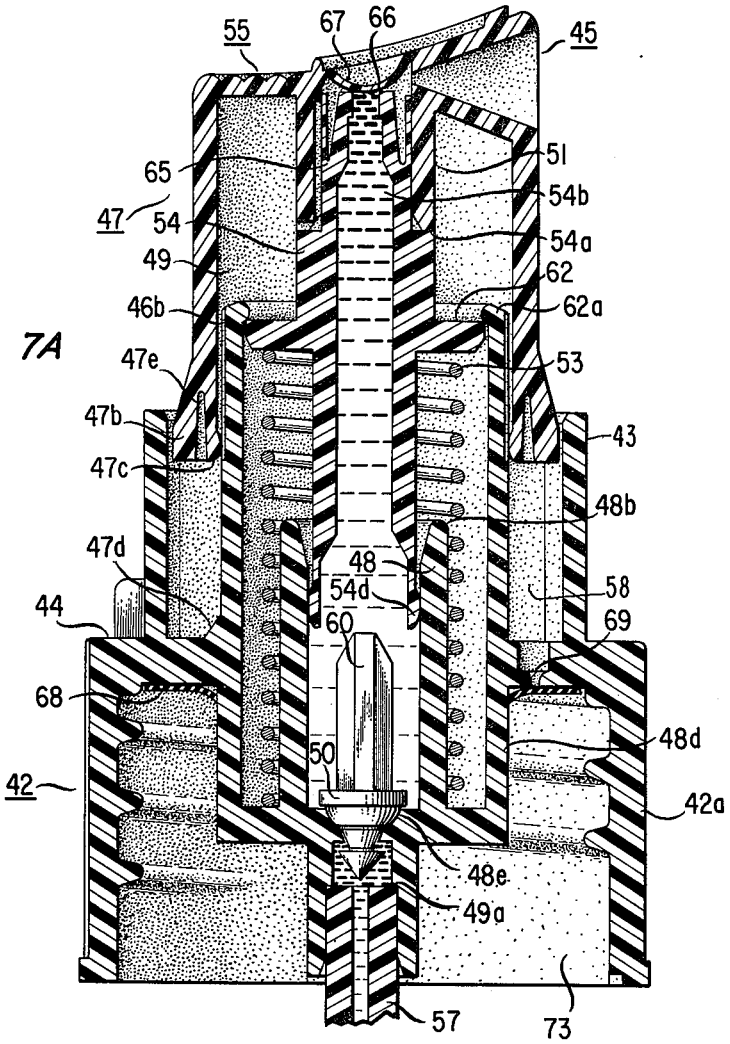
FIG. 7A shows a modification of the spray dispenser of the present invention in enlarged vertical section similar to FIG. 2A.
Figure 7B:
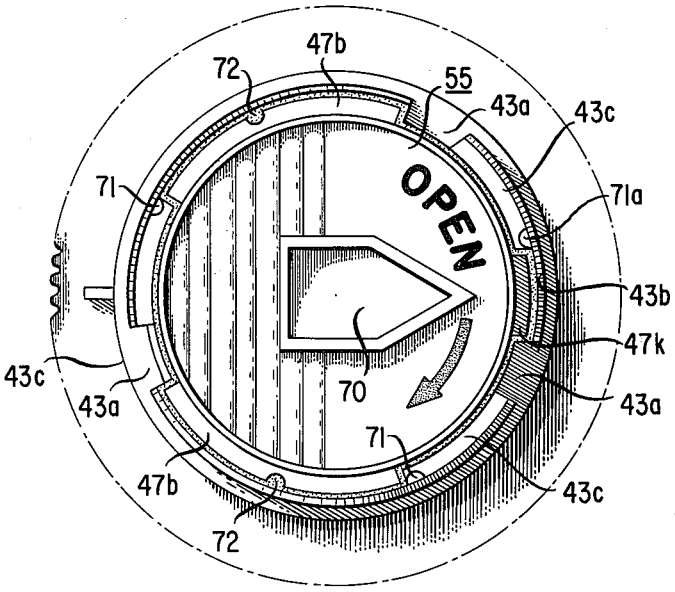
FIG. 7B is an enlarged top view of the modified spray dispenser shown in FIG. 7A.

Referring to FIGS. 7A and 7B of the drawings, there is shown, in vertical section and top view, a modification of the embodiment disclosed in FIGS. 2A et seq. For convenience of description of FIGS. 7A, 7B, 8A, 8B, 9A 9B and 9C, components similar to FIGS. 2a et seq. are indicated by numbers to which 40 has been added; thus, screw cap accumulator 42 of FIG. 7A corresponds to screw cap accumulator 2 of FIG. 2A, etc. Unless otherwise indicated, correspondingly numbered parts in the embodiment of FIGS. 7A, 7B et seq. may be assumed to be substantially similar to those described with reference to FIGS. 2A et seq., and to cooperate in a similar manner.

The principal differences between the embodiment previously described and the embodiment of FIGS. 7A, 7B, under description, are the following.

Figure 8A:
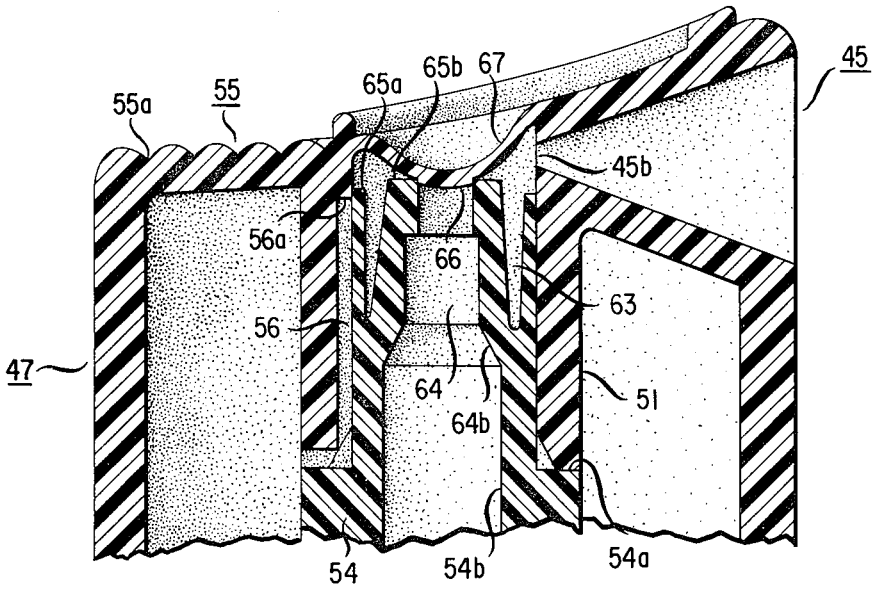
FIG. 8A is an enlarged vertical sectional showing of the upper end of the modified spray nozzle housing of FIG. 7A with the diaphragm in neutral position, the interposed plug having been substantially eliminated.
Figure 8C:
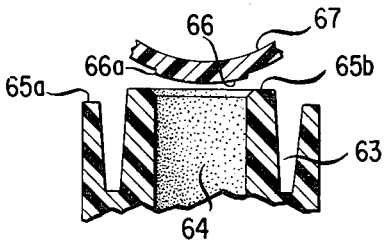
FIG. 8C is a detail, showing the relationship between the annular edge **66*a* and the bevelled ring 65*b***.
Figure 8B:
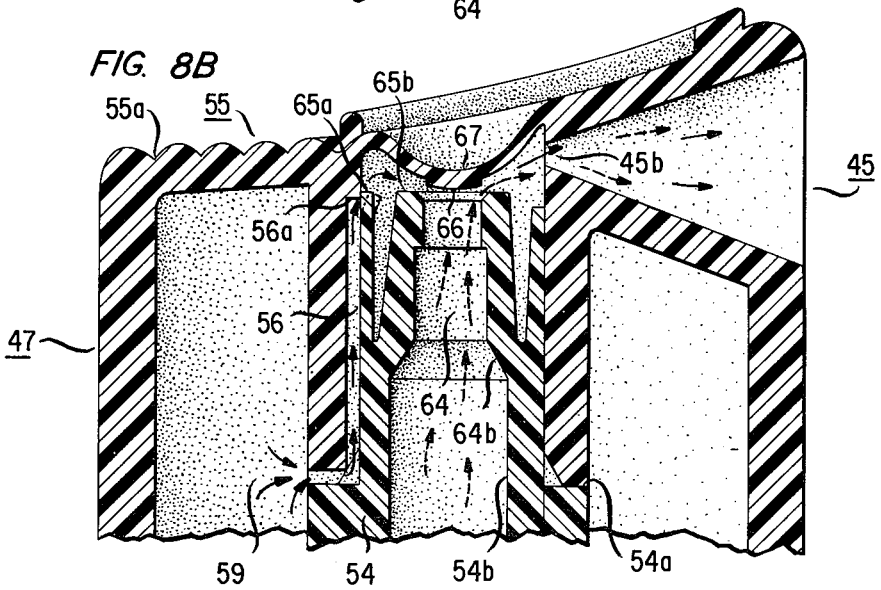
FIG. 8B is an enlarged vertical sectional showing of the modified spray nozzle housing corresponding to FIG. 8A with the diaphragm deflected.

1. The serrated plug 26 of FIG. 2A has been nearly eliminated in the embodiment of FIG. 7A, being replaced by a slight central protuberance 66 having an annular shoulder 66*a,* say, two or three mils thick. Diaphragm 67 is under preload tension of, say, 30 pounds, to provide for the top seal against shoulder 65*b.* (See FIGS. 8A, 8B, 8C.) The diaphragm 67, which may be, for example, 10 mils thick, is formed of low density polyethylene, whereas the slightly bevelled annular shoulder 65*b* is formed of high density polyethylene. In sealed relation annular shoulder 66*a* digs into the bevelled surface of shoulder 65*b,* causing the seal to improve with time. The function of this change in the shape of the diaphragm 67 from the previous embodiment, and elimination of the plug in favor of the slight protuberance 66, is to render spray delivery more uniform and constant. Deflection of diaphragm 67 and shoulder 65*a* to admit liquid and a blast of air into the mixing chamber 63 is shown in FIG. 8B. Otherwise, the operation is substantially similar to that disclosed with reference to the embodiment of FIGS. 2A et seq.

2. The locking feature described specifically with reference to FIG. 3 of the drawings has been changed in the embodiment of FIGS. 7A, 7B to substitute two circumferentially extended lugs 47*b,* plus a third smaller lug 47*k,* all centered 120° apart, instead of the four symmetrically disposed lugs 7*b* of FIG. 3. In FIG. 7B, the tip of arrow 70 points, in operating position of the pump, to the center of short lug 47*k,* which extends about 0.14 inch around the periphery, on an arc having a radius of 0.34 inch. The lugs 47*b* comprise arcs extending 0.43 inch around the periphery. Each of lugs 47*b* and 47*k* protrudes 0.03 inch in a radial direction, being separated by intervening slots. It will also be noted from FIG. 7A that the profile of these lugs is slightly changed from the corresponding lugs of FIG. 2A. Referring to FIG. 7B, the flanges 43*a* extend inwardly 0.03 inch from the inner periphery of the cylindrical accumulator 43 in interlapping relation with lugs 47*b* and 47*k.* Flanges 43*a* are centered at angles of 20°, 160° and 300°, respectively, moving clockwise from the zero position indicated by the arrow 70, the first flange extending approximately 0.08 inch, and the latter two extending 0.1 inch around the inner periphery of a circle having a radius of 0.32 inch. Recessed adjacent thereto, and about 3/64 inch inches below flanges 43*a,* are the annular planes 43*c* which are centered from the reference point at angular clockwise positions of approximately 50°, 190° and 330°, respectively, each extending approximately 0.2 inch around the periphery on a circle having a radius of about 0.31 inch. Near the centers of each of the lugs 47*b* is a dimple 72 which is respectively designed to accommodate a small bead 71, just above the clockwise end of adjacent ones of the recessed flanges 43*c,* so that when the cylinderical housing 47 is rotated in a counterclockwise direction, lugs 47*b* engage flanges 43*c* and the beads 71 are accommodated in dimples 72, firmly locking against rotation. When the housing 47 is rotated to open position, as shown in FIG. 7B, one of the flange 43*a* on the clockwise side, and bead 71*a* on the counterclockwise side act as stops, engaging lugs 47*k* to maintain housing 47 in proper operating position. Stop 71*a* is overridden when spray housing 47 is turned to locking position.

3. Another change in the embodiment of FIGS. 7A, 7B, relative to that of FIG. 2A, is in the shape and thickness of the wall of piston 14, and in the relationship between the lower portion of the piston wall and the upper end of the tubular valve housing 8. In FIGS. 7A, 7B the thickness of the upper portion of piston wall 54 (corresponding to piston 14 in FIG. 2A) has been nearly doubled between the upper face of annular flange 62 and shoulder 54*a.* Also, for a vertical length 0.12 inch from the bottom of the tube, the wall thickness of 54 has been cut back to 0.015 inch; and an annular bead 54*d,* centered 0.04 inch above the bottom and having a maximum thickness of 0.02 inch, is imposed on the outer periphery. This bead bears against the inner wall of the tubular valve housing 48. The latter has also been modified so that the bead corresponding to 8*b* of FIG. 2A has been omitted. From about 0.075 inch below the top 48 is internally tapered from a wall thickness of 0.05 inch to about 0.025 inch at the rounded top edge. Thus, the lower end wall or "skirt" of the tube 54 has been made more flexible than in the previous embodiment, the annular bead 54*d* pressing against the inner wall of tubular valve housing 48 to provide a better seal.

Figure 9A:
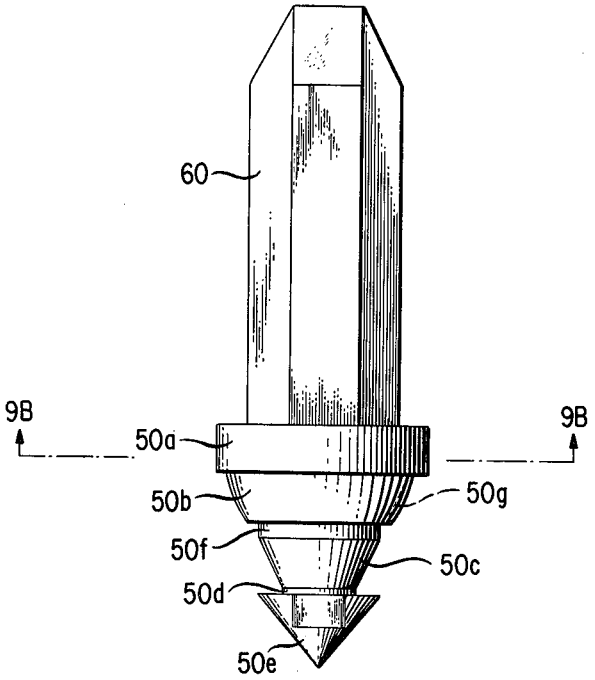
FIG. 9A is an enlarged perspective showing of the valve head assembly shown in FIG. 5A, modified to permit a slight drainback into the reservoir when the valve is closed.
Figure 9B:
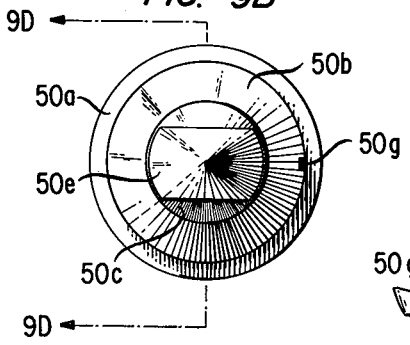
FIG. 9B is a view of the valve head of FIG. 9A looking up from the bottom.
Figure 9D:
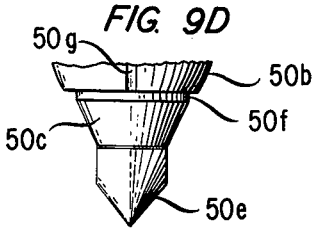
FIG. 9D is an enlarged fragmentary view of the lower end of the valve head assembly along the plane 9D—9D of FIG. 9B.
Figure 9C:
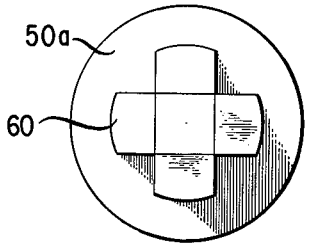
FIG. 9C is a view of the valve head assembly of FIG. 9A, looking down from the top.

4. Further salient features of the embodiment of FIGS. 7A, 7B, particularly as indicated with reference to FIGS. 9A, 9B, 9C and 9D, are several slight but significant changes made in the shape of the valve head 50 which replaces the valve head 10 of FIG. 2A. The overall length of the valve head assembly, including cruciform valve stem 60, has been reduced to 0.430 inch to increase the capacity of the pump. Valve stem 60 is centered on the upper face of cylindrical wafer 50*a,* which is 0.14 inch in diameter and 0.03 inch thick. On the under surface of the latter is mounted a spheroid section 50*b,* 0.045 inch along its axis, and having a radius 0.065 inch centered 0.01 inch above the lower face of 50*a.* Centered on the plane circular face on the bottom of 50*b* is a cylinder 50*f* which is 0.01 inch thick and 0.078 inch in diameter, the lower end being tapered conically along an axial distance 0.021 inch, terminating in a cylindrical wafer 50*d* having a thickness of 0.004 inch and a diameter of 0.05 inch. On the latter is centered the base of the tip portion comprising a cone of which the circular sides have been flattened to make it substantially elliptical in shape, as indicated in FIG. 9B, having a maximum diameter of 0.078 inch, a width of 0.050 inch and extending 0.05 inch along its axis, terminating in an apex at the bottom. The side elevation is shown in FIG. 9D.

In order to prevent what is termed "throttling" or dribbling from the spray head between blasts of spray, it is desirable to provide a clearance between the valve head 50 and the valve seat 48*e,* so that when the valve is closed a small amount of liquid is dumped back into the container through the tube 57. One method of providing such a clearance is by means of a vertical slot 50*g,* which may be, as a maximum, say, 10 mils wide and 5 mils deep, extending through the thickness of spheroidal member 50*b.* Another alternative is to reduce the diameter of spheroidal member 50*b* so that when valve head 50 is seated in valve seat 48*e* (FIG. 7A) a slight clearance allows some liquid to pass through. Thus, when the spray nozzle housing 47 is depressed quickly to operate the pump and the valve seats, a small proportion of the liquid passes back into the container; whereas under slow finger compression all the liquid returns to the container. In the latter case high pressure is prevented from building up on the internal chamber of piston 54 which would tend to override the force of 30 pounds on the diaphragm 67, causing it to unseal and leak liquid out of the spray nozzle between pump strokes. With the modified valve head, as shown in FIGS. 9A, 9B, 9C and 9D, the spray emerging from the nozzle tends to be more uniform and constant in volume than in the case in which the valve head seats tightly.

5. Another modification in the embodiment shown in FIGS. 7A, 7B is provided by replacing the molded rubber gasket 28 of FIG. 2A with a substantially flat die-cut gasket 68 of natural or synthetic rubbers such as, for example, neoprene or the material known by the trademark "Buna", or other flexible material. The gasket 68 is flat, ¾ inch in outer diameter and ½ inch in inner diameter and about two mils thick. In the cover of the accumulator, the opening 29, as shown in FIG. 2A, has been replaced in FIGS. 7A, 7B by a substantially larger circular opening 69 in the cover 44, which communicates between chambers 58 and 73. The upper portion of opening 69 is substantially equal in diameter and depth, being about 0.06 inch; and it narrows down to about 0.025 inch across the lower end. Gasket 68 is friction fit so that it seals to the wall of housing 48*d,* its inner end extending 0.06 inch below the under face of partition 44. The flat annular upper surface of diaphragm 68 is secured in place by the neck of the container 1 (FIG. 1) when the cap is fastened in place thereon, so that it just covers the opening 69, which seals closed when the pressure in the chamber 73 is greater than the pressure in air intake chamber 58 and which opens to admit air when the pressure in the container falls below atmospheric pressure. This serves to replace air which has been removed from the container through pumping, or normal atmospheric pressure changes, maintaining the product liquid at substantially atmospheric pressure in the container.

The following are salient features of the present invention.

a. The top seal is preloaded, allowing the valve to open only when in use, eliminating crystallization and clogging or dripping at the orifice.

b. The pump can be securely latched in an inoperative position for shipping or carrying.

c. A blast of compressed air mixes with the fluid product to produce atomization without a mechanical swirl chamber, and serves to clean the orifice after each stroke.

d. There is no metal in contact with the product, and the check valves are of plastic characterized by positive opening and closing, so that corrosion is substantially eliminated.

e. The product delivery rate can be increased or decreased by merely increasing the capacity of the piston, or by changing the sizes of the orifices.

f. The spray is delivered at a constant pressure, and throttling and dribbling from the nozzle are substantially eliminated.

g. The automatic vent from the accumulator cap substantially eliminates the problems of leakage from the nozzle and collapse of the container.

h. The combination of the present invention has many fewer parts than similar prior art devices.

For the purposes of the present invention, the term "fluid" may be defined as a mass of material which readily flows and changes shape. Although a preferred application of the invention is to dispense a high pressure spray of a liquid product, which may include oil, it will be understood that the principles of the present invention can also be applied to dispense certain types of gaseous or vapor products, or alternatively, powdered or particulate products, in a compressed gas carrier. Whereas in the preferred embodiments of the invention, it is contemplated that compressed air will be used as the carrier gas, it will be understood that the principles of the present invention can be applied to any gas in the environment surrounding the dispenser which can readily be compressed to serve as a carrier for the product.

It will be further understood that this invention is not limited to devices of the specific materials, forms or dimensions of the disclosed examples or to the specific features or advantages set forth. It will be understood that the parts could be made from any semirigid plastic material which is impervious to air and does not react in a manner to produce toxic by-products with the liquid product of the container. The present examples are submitted for the purposes of illustration only, and are not to be construed as limiting the scope of the invention, which is defined by the appended claims.

What is claimed is:

1. A pressure actuated dispenser including a spray nozzle constructed in combination with the closure of a container of a reservoir of fluid product for dispensing said product in a carrier gas in the form of high pressure spray, said dispenser comprising in combination:

means including fixed and movable elements forming an annular variable volume carrier gas chamber constructed for compression and expansion in response to pressure and release from pressure on said dispenser;

a pump for said fluid product, said pump including a pump chamber and a hollow stem piston mechanically coupled for reciprocating action in synchronism with said movable elements of said variable volume chamber;

central valve means communicating between said product reservoir and said pump chamber;

means for maintaining said reservoir at substantially ambient pressure;

means for forming a mixing chamber surrounded by said annular gas chamber, said mixing chamber having an aperture communicating with said spray nozzle, and comprising a first inlet means including a normally closed flexible member of membraneous material for admitting said compressed carrier gas from said variable volume carrier gas chamber to said mixing chamber, and a second inlet means including a normally closed flexible member of membraneous material for admitting fluid product under pressure from said hollow stem piston to said mixing chamber;

a first means responsive to an initial compression stroke on said dispenser for simultaneously depressing said hollow stem piston to close said central valve means, compressing the carrier gas in said variable volume carrier gas chamber and deflecting the normally closed flexible member of said first inlet means to admit a blast of said compressed carrier gas into said central mixing chamber;

a second means responsive to a subsequent return stroke of said hollow piston stem upon release of pressure on said dispenser, to release said central valve means and to draw said fluid product into said pump chamber; and said first means responsive to the subsequent compression strokes of said dispenser for simultaneously again depressing said hollow stem piston to close said central valve means while pumping said fluid product from said pump chamber up through said hollow stem piston again compressing the carrier gas in said variable volume carrier gas chamber, deflecting the flexible member of said first inlet means to admit a blast of said compressed carrier gas through said first inlet means and deflecting the flexible member of said second inlet means to admit said product through said second inlet means to admit said product through said second inlet means to mix in said mixing chamber to form an atomized spray of said product which is propelled out through said spray nozzle.

2. A pressure actuated dispenser in accordance with claim 1 wherein said carrier gas is ambient air.

3. A pressure actuated dispenser in accordance with claim 2 wherein said product is primarily liquid at ambient temperature and pressure.

4. A pressure actuated dispenser in accordance with claim 3 wherein said valve means disposed between said roduct reservoir and said pump chamber comprises a valve head and a valve seat, said valve head having a valve stem disposed for controlled reciprocating motion in the hollow stem piston of said pump, and means comprising a clearance when said valve head is seated on said valve seat for permitting drain-back of a minor portion of said liquid product into said reservoir when said valve is closed under slow finger compression.

5. A pressure actuated dispenser in accordance with claim 4 in which said clearance comprises a groove in said valve head providing an opening through said valve when said valve head is seated on said valve seat.

6. A pressure actuated dispenser in accordance with claim 5 wherein the maximum internal diameter of said valve seat exceeds the minimum outer diameter of said valve head providing space between said valve head and said valve seat when said valve head is seated on said valve seat permitting drain-back of a minor portion of product liquid into said container under slow finger compression.

7. A pressure actuated dispenser in accordance with claim 2 wherein said product comprises primarily flowable particulate material.

8. A pressure actuated dispenser in accordance with claim 2 wherein said product comprises primarily powder.

9. A pressure actuated dispenser in accordance with claim 2 wherein said product is primarily gaseous at ambient temperature and pressure.

10. The combination in accordance with claim 1 wherein said means for maintaining said reservoir at substantially ambient pressure comprises a perforation in the top of said container closure which provides for the passage of atmospheric air into and out of said container, and a flat flexible annular diaphragm sealed at its inner periphery to the housing of said valve means and held in place between said container and the inner surface of said container closure to provide an internal seal for said perforation which is constructed to remain sealed when the internal pressure of said container exceeds the ambient pressure, and to unseal admitting air, when the ambient pressure exceeds said internal pressure.

11. The combination in accordance with claim 1 including means for maintaining said spray nozzle alternately in locked or dispensing position relative to the closure of said container which comprises in combination:

a cylindrical housing for said spray nozzle telescopically assembled in rotatable relation with the closure of said container, the closure of said container having an inwardly directed flange with at least one slot, said cylindrical housing having at least one lug directed outwardy from the periphery thereof in mating relation with a slot of said flange and providing with said flange a stop at a preselected position in the rotation of said housing.

12. The combination in accordance with claim 11 wherein said flange comprises portions at different lateral levels on the interior of said cylindrical housing, the first said flange portion at one said level disposed to directly engage one said lug to provide a stop, and the second said flange portion at another said level disposed for abutting engagement with one said lug preventing up and down pumping motion of said cylindrical housing relative to said container closure when said housing is rotated to locking position relative to said closure, and means comprising at least one boss adjacent one said lug and at least one dimple in said second flange portion for securing said cylindrical housing and said spray nozzle in rotationally locked relation.

13. A finter actuated spray pump mechanism having neutral and compressed positions comprising a pump cycle, for dispensing a fluid product comprising in combination:

a substantially cylindrical accumulator top constructed and arranged to be fitted in removable relation to the top of a container of a reservoir of said fluid product;

said accumulator top substantially closed at its upper end except for an axially disposed valve including a valve head and a valve opening in a housing integrally formed at the center of said accumulator, and means comprising an air vent constructed to admit air to said container when the interior is below ambient pressure;

said valve opening communicating with said reservoir of fluid product;

said accumulator top including a pair of upwardly directed coaxial sleeves forming an outer annular chamber and an inner annular chamber coaxially surrounding said valve;

a nozzle housing comprising a hollow cylinder having a closed upper end including a spray nozzle, the open lower end of said nozzle housing being accommodated for telescopic movement in said outer annular chamber, corresponding to the neutral and compressed positions of said pump cycle, and forming with means including a portion of said inner annular chamber a variable volume air chamber constructed to expand and contract with said telescopic motion for providing compressed air;

a receptacle including a downwardly directed preloaded spring-biased sealing element depending in axial relation from the upper end of said nozzle housing, a hollow piston having a grooved fitting at its upper end, said receptacle constructed to mate with said grooved fitting so that said hollow piston is disposed in fixed coaxial relation with said receptacle and said outer and inner annular chambers for reciprocating motion in conformity with the telescopic motion of said nozzle housing in said outer annular chamber;

means comprising a spring constructed to urge said nozzle housing and said hollow piston to the neutral position of said pump cycle;

the lower end of said hollow piston constructed to at least partially close said valve in the compressed position of said pump cycle, and to release said valve to open when said hollow piston is in the neutral position of said pump cycle, said hollow piston disposed to serve as a channel for fluid product passing through said valve;

said grooved fitting forming with said receptacle a mixing chamber and intake means;

a first said intake means for compressed air connected between said variable volume air chamber and said mixing chamber;

a second said intake means including said preloaded spring-biased sealing element for product fluid connected between said hollow piston and said mixing chamber;

said grooved fitting constructed during at least part of said pump cycle to maintain said second intake means in closed position, and during another part of said pump cycle in response to internal product fluid pressure in said hollow stem piston to open said second intake means in response to overriding pressure on said preloaded spring-biased sealing element to admit fluid product to said mixing chamber, and to simultaneously admit compressed air into said mixing chamber through said first intake means, whereby said compressed air atomizes said fluid product and expels atomized spray through said spray nozzle.

14. The combination in accordance with claim 13 wherein said fluid product comprises primarily liquid at ambient temperature and pressure.

15. The combination in accordance with claim 13 including means for maintaining said nozzle housing in a desired orientation relative to said accumulator top which comprises an inwardly directed flange on the upper inner periphery of the outer one of said coaxial sleeves, said flange having at least one slot;

at least one lug directed outwardly from the periphery of said nozzle housing for mating with the slot on said flange.

16. The combination in accordance with claim 15 including means responsive to a slight preselected rotation of said nozzle housing about its principal axis away from said desired orientation for locking said nozzle housing against telescopic movement in the outer one of said coaxial sleeves, said means including at least one recess in said flange means for abutting engagement by at least one said lug.

17. The combination in accordance with claim 13 wherein said valve head is elliptical in cross-section, the large axis of said ellipse exceeding the diameter of said valve opening, and the smaller axis of said ellipse being less than the diameter of said valve opening.

18. The combination in accordance with claim 13 wherein said means comprising a spring for urging said housing and said hollow piston to neutral position comprises in combination:

a coil spring disposed in said inner annular chamber in coaxial relation with the lower end of said hollow piston;

an outwardly directed annular flange rigidly fastened part-way up on said hollow piston and disposed to move in reciprocating relation in said inner annular chamber to bear on the upper end of said coil spring, whereby the reciprocating motion of said nozzle housing including said hollow piston is constrained against the compression of said coil spring.

19. The combination in accordance with claim 18 wherein said variable volume air chamber comprises the annular space between the inner peripheral wall of said nozzle housing and the outer wall of said hollow piston, the lower end of said chamber being bounded by a portion of said accumulator top, and means for admitting air into said chamber during one phase of said pump cycle, and exhausting compressed air from said variable volume chamber into said mixing chamber through said first intake means during a different phase of said pump cycle.

20. The combination in accordance with claim 13 in which said first intake means for compressed air connected between said variable volume air chamber and said mixing chamber comprises a normally closed flexible member of membraneous material which is deflected during one part of said pump cycle in response to overriding pressure in said variable volume air chamber.

21. The combination in accordance with claim 13 wherein said means comprising an air vent in said accumulator top comprises an internal diaphragm of elastomer material secured to the under side of said accumulator top and constructed to seal against the interior of said vent when the pressure in said container is at least equal to ambient pressure, and to relax and admit air when the pressure in said container is below ambient pressure.

22. The combination in accordance with claim 13 wherein the grooved fitting at the upper end of said hollow piston, forming part of said first and second intake means, comprises concentric outer and inner annular rings separated by an annular gooove, the inner said ring extending substantially beyond the outer said ring in an axial direction, said inner ring surrounding said preloaded spring-biased sealing element;

said preloaded spring-biased sealing element comprising a diaphragm plug having an annular shoulder which in closed condition of said second intake means is disposed in flush relation against the inner periphery of said inner ring just below the top, and in open condition of said second intake means is slightly spaced apart from said inner ring to admit fluid product;

said receptacle having an inner annular shoulder surrounding said outer ring, and spaced slightly above said outer ring when said first intake means is in open condition to admit compressed air.

23. The combination in accordance with claim 22 in which said plug is longitudinally fluted around its peripheral edge for breaking up the fluid product.

24. The combination in accordance with claim 22 in which the internal bore of the grooved fitting, adjacent the said plug, is fluted longitudinally, and the lateral surface of the plug is substantially smooth.

25. The combination in accordance with claim 13 wherein said downwardly directed spring-biased sealing element comprises a preloaded diaphragm including on its lower convex surface a central protuberance surrounded by an annular shoulder, said grooved fitting comprising at its upper end an internal and an external annular collar, said internal collar which mates with said hollow piston having a slightly bevelled upper edge against which said annular shoulder bears when said second intake means, including said preloaded sealing element, is closed.

26. A pressure actuated dispenser constructed to dispense fluid product in a compressed gas carrier from a container comprising a reservoir of said fluid product, said dispenser comprising in combination:

a dual cylinder pump including an annular variable volume chamber and a central pump for the fluid product disposed axially in said chamber, said central pump including a pump chamber and a hollow stem piston;

a centrally disposed control valve for communicating between said pump chamber and said reservoir;

said variable volume chamber being defined by fixed and movable elements which allow the variable volume chamber to contract and expand for the compression and intake of carrier gas upon compression and release from compression of said dispenser, and said hollow stem piston being coupled for movement in synchronism with the movement of the movable elements of said variable volume chamber, to cause the closing and opening of said control valve to said fluid product reservoir;

said dual cylinder pump including a centrally disposed mixing chamber having a first normally closed intake means for admitting compressed carrier gas from said variable volume chamber, and a second normally closed intake means for admitting fluid product from said hollow stem piston, each constructed to open in response to a preselected pressure for mixing said fluid product with said compressed gas carrier to form an atomized spray;

and means comprising a spray nozzle connected to said mixing chamber for exhausting said spray from said mixing chamber in a high pressure stream.

27. The combination in accordance with claim 26 wherein said fluid product is liquid, and said carrier gas is air.

28. The combination in accordance with claim 26 wherein said first and second normally closed intake means respectively comprise:

a flexible member of membraneous material connected between said variable volume chamber and said mixing chamber and responsive to overriding internal pressure in said variable volume chamber to deflect for admitting compressed carrier gas into said mixing chamber; and a preloaded diaphragm connected between said hollow stem piston and said mixing chamber and responsive to a preselected internal pressure of the fluid product in said hollow stem piston for admitting fluid product to said mixing chamber.

* * * * *

UNITED STATES PATENT AND TRADEMARK OFFICE

CERTIFICATE OF CORRECTION

PATENT NO. : 4,057,176

DATED : November 8, 1977

INVENTOR(S) : William Horvath

It is certified that error appears in the above-identified patent and that said Letters Patent are hereby corrected as shown below:

Column 2, line 11, change "seal" to --seat--; line 38, change "sleeve" to --sleeves--; line 44, after "annular" and before "chamber" insert --air--. Column 5, line 2, change "3a" 2nd. occ. to --3c--; line 63, after "shoulder" insert --4--. Column 9, line 21, change "to" to --the--; line 45, change "crucifform" to --cruciform--. Column 10, line 20, change "14d" (second occurrence) to --14b--; line 49, change "mozzle" to --nozzle--. Column 11, line 30, change "whih" to --which--; line 46, change "2a" to --2A--. Column 12, line 44, change "cylinderical" to --cylindrical--. Column 15, line 64, at the end of the line, cancel "to"; cancel line 65. Column 16, line 8, change "roduct" to --product--. Column 17, line 16, change "finter" to --finger--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*